US007282656B2

(12) United States Patent
Niiyama

(10) Patent No.: US 7,282,656 B2
(45) Date of Patent: Oct. 16, 2007

(54) SLIDE SWITCH

(75) Inventor: Takashi Niiyama, Isesaki (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 11/412,537

(22) Filed: Apr. 27, 2006

(65) Prior Publication Data

US 2006/0260925 A1 Nov. 23, 2006

(30) Foreign Application Priority Data

Apr. 28, 2005 (JP) ..... 2005-133129

(51) Int. Cl.
*H01H 25/00* (2006.01)

(52) U.S. Cl. ..... 200/5 R; 200/6 A

(58) Field of Classification Search ..... 200/5 R, 200/6 A, 17 R, 18; 273/148 B; 341/20, 341/22, 35; 345/156, 157, 160, 161, 163, 345/167, 168, 169, 184; 463/36–38
See application file for complete search history.

(56) References Cited

U.S. PATENT DOCUMENTS 6,069,327 A * 5/2000 Ushimaru ..... 200/5 R
6,528,740 B2 * 3/2003 Miyoshi ..... 200/5 R
6,608,263 B2 * 8/2003 Myojin ..... 200/16 DD
6,689,967 B2 * 2/2004 Myojin ..... 200/18
6,765,165 B1 * 7/2004 Torrens ..... 200/512
6,831,238 B1 * 12/2004 Lau ..... 200/6 A
6,965,084 B2 * 11/2005 Kumasaka et al. ..... 200/6 A

FOREIGN PATENT DOCUMENTS

JP 11-111119 4/1999
JP 2002-140960 5/2002

* cited by examiner

*Primary Examiner*—Michael Friedhofer
(74) *Attorney, Agent, or Firm*—The Webb Law Firm

(57) ABSTRACT

A slide switch having a reduced number of parts and formed thin. The slide switch includes a case having first electrode pairs and a second electrode pair arranged in a bottom thereof, a slide member slidably mounted in the case, and a biasing member for biasing the slide member. The biasing member has projections formed on one surface of a floor thereof, and each having a back wall portion, and a first electric conductor disposed opposite the back wall portion. When the slide member is operated in the direction of one of the projections against a biasing force, the projection is elastically deformed whereby the electrodes of the first electrode pair become conductive through the first electric conductor. When the slide member in a neutral position is pressed in the direction of the floor, the electrodes of the second electrode pair become conductive through the second electric conductor.

6 Claims, 9 Drawing Sheets

SLIDE SWITCH

BACKGROUND OF THE INVENTION

1. Field of the Invention

This invention relates to a slide switch having a slide member slidably mounted in a case, and a biasing member for biasing the slide member to a neutral position, in which an electrically conductive state is produced by operating the slide member against the biasing force of the biasing member.

Further, the invention relates to a slide switch of the multi-contact type that produces an electrically conductive state also when the slide member is depressed.

2. Description of the Related Art

A slide switch as noted above is described in Japanese patent application laid open under "kokai" No. H11-111119 (Patent Document 1) (see paragraphs 21-26, paragraph 31, FIG. 2, FIGS. 4-6 and FIGS. 8-11, for example). This slide switch is a multi-contact input device having a first switch operable by a depressing operation of a control member, and a plurality of second switches operable through a rocking operation of the control member.

The first switch is opened and closed through a snap operation resulting from a pressing of a metallic dome by the depressing operation of the control member. The second switches are arranged in a plurality of positions around and equidistant from the first switch. The rocking operation of the control member presses arch-like snap plates, and the snap operation thereby produced opens and closes the switches.

The following construction is shown in Patent Document 1 as a preferred embodiment. In this construction, the first switch is disposed at the center. Four second switches are arranged at intervals of 90 degrees around and equidistant from the first switch. One of the second switches is opened and closed by rocking of the control member. Projections are provided to restrict an amount of rocking movement in fixed directions to prevent simultaneous opening and closing of two of the second switches.

Japanese patent application laid open under "kokai" No. 2002-140960 (Patent Document 2) describes the following slide switch (see paragraphs 6-11, paragraphs 23-30, FIGS. 2-6 and FIG. 10, for example). What is described therein is a slide switch which produces an electrically conductive state by operating a slide member against a biasing force of a biasing member biasing the slide member to a neutral position.

The biasing member has a holding portion defining a square opening for receiving and supporting peripheral walls of the slide member which is also shaped square. As a result, the slide member is biased to the neutral position. The biasing member is mounted in a case having a square bottom wall larger than the slide member, and wall portions extending upward from the bottom wall so as to surround the circumference of the bottom wall. The biasing member has projections extending from corners of the square opening toward corners of the wall portions. These projections define slits opening from the corners of the opening in directions in which the projections are formed. When the slide member is slid, the slits will open, and an electric conductor disposed outside the opening of the biasing member will bring into conduction a pair of electrodes provided on the wall portions of the case.

Patent Document 2 further describes a multi-contact slide switch which produces an electrically conductive state when the slide member is depressed.

SUMMARY OF THE INVENTION

With the switch of Patent Document 1, the four second switches arranged peripherally are opened and closed by a rocking operation of the control member. This requires a two-step operation of pushing and tilting the control member. Although a mechanism is provided to regulate the control member, taking into account the plurality of second switches being inputted simultaneously, the possibility that the first switch and second switches are inputted simultaneously is not eliminated completely.

With the switch of Patent Document 2, a switch disposed peripherally is opened and closed by sliding operation of the slide member, and the switch at the center is opened and closed by depression of the slide member. Since two switches are operated by the different operations, the possibility that the switches are inputted simultaneously is lower than with the construction of Patent Document 1. As opposed to the four snap plates of Patent Document 1, in Patent Document 2, the slide switch at the periphery is opened and closed by using one biasing member. Therefore, the switch of Patent Document 2 can be formed of a smaller number of parts.

Indeed, the switch of Patent Document 2 can be formed thin when it has only the switch of the slide type (see FIG. 3 of Patent Document 2). However, when it has a switch operable by depressing operation, the construction will have a correspondingly increased thickness (see FIG. 10 of Patent Document 2). This is because an intermediate operation member (see reference numeral 15 in FIG. 10 of Patent Document 2) under the switch of the slide type, and the depression switch under this intermediate operation member. That is, this double structure increases the thickness of the entire switch, and the need for the intermediate operation member results in a corresponding increase in the number of parts.

This invention has been made having regard to the drawbacks noted above, and its object is to provide a slide switch that can be formed thin with a reduced number of parts.

The above object is fulfilled, according to this invention, by a slide switch comprising a slide member slidably mounted in a case, and a biasing member for biasing the slide member to a neutral position, wherein the slide switch produces an electrically conductive state when the slide member is operated against a biasing force of the biasing member. This slide switch has the following further characteristic features.

The case includes at least one electrode pair arranged in a bottom thereof.

The biasing member includes projections each having a back wall portion for biasing the slide member to the neutral position, and an electric conductor disposed opposite the back wall portion.

When the slide member is operated in the direction of one of the projections against the biasing force, the one of the projections is elastically deformed whereby the electrodes of the electrode pair become conductive through the electric conductor.

The above characteristic construction of the slide switch according to this invention provides the following excellent functions and effects.

The biasing member includes projections, and biases the slide member to the neutral position with the back walls of the projections. When the slide member is operated in the direction of one of the projections against the biasing force, this projection is elastically deformed. An electric conductor is disposed opposite the back wall of the projection. As the projection is elastically deformed, this electric conductor makes conductive the electrodes of the electrode pair int the bottom of the case. The electric conductor for making the electrode pair conductive is formed integral with the biasing member. Thus, the slide switch can be formed of a reduced number of components.

Although the biasing member includes electric conductors also in the construction described in Patent Document 2 noted hereinbefore, the electrodes are provided on wall surfaces extending upward from the bottom of the case. This requires the wall surfaces to have a sufficient height for the electrodes, and this sets a limit to a reduced thickness of the slide switch. In the construction of this invention, the electrode pairs are arranged in the bottom of the case, and the wall surfaces may be reduced in height easily without being restricted by the electrodes.

Thus, according to this characteristic construction, the slide switch has a reduced number of parts, and may be formed thin.

It is preferred that the slide switch according to this invention, in addition to the above construction, is constituted as follows.

The electrode pair and the projection are arranged at each of four edges of the bottom of the case formed rectangular. When the slide member is operated in the direction of one or two of the projections against the biasing force, the electrodes of the electrode pair become conductive through the electric conductor or conductors of the one or two of the projections.

The electrode pair is arranged at each of the four edges of the bottom of the rectangular case, and the projection at each of the four edges of the rectangular biasing member. Then, the back walls of the projections face the center of the rectangular biasing member, and are opposed to one another. The slide member formed rectangular in a similar shape to the case and biasing member are reliably supported at the four edges thereof by the four back wall portions. As a result, the slide member is reliably biased to the neutral position. Thus, the slide switch provided has an increased number of contacts.

In another aspect of the invention, a slide switch comprises a slide member slidably mounted in a case, and a biasing member for biasing the slide member to a neutral position, wherein the slide switch produces an electrically conductive state when the slide member is operated against a biasing force of the biasing member. This slide switch has the following further characteristic features.

The case includes at least one first electrode pair and one second electrode pair arranged in a bottom thereof.

The biasing member includes projections each having a back wall portion extending upward from one surface of a flat floor for biasing the slide member to the neutral position, and a first electric conductor disposed opposite the back wall portion, a second electric conductor being disposed adjacent a reverse surface of the floor.

When the slide member is operated in the direction of one of the projections against the biasing force, the one of the projections is elastically deformed whereby the electrodes of the first electrode pair become conductive through the first electric conductor.

When the slide member in the neutral position is pressed in the direction of the floor, the electrodes of the second electrode pair become conductive through the second electric conductor.

According to this characteristic construction, the biasing member includes projections, and biases the slide member to the neutral position with the back walls of the projections. When the slide member is operated in the direction of one of the projections against the biasing force, this projection is elastically deformed. A first electric conductor is disposed opposite the back wall of the projection. As the projection is elastically deformed, this first electric conductor makes conductive the electrodes of the first electrode pair in the bottom of the case. When the slide member in the neutral position is pressed in the direction of the floor of the biasing member, the second electric conductor makes the electrodes of the second electrode pair conductive. At least the first electric conductor for making the first electrode pair conductive is formed integral with the biasing member. The second electric conductor, although a separate part, is one part. Thus, the slide switch can be formed of a reduced number of components. The number of components may of course be reduced further where the second electric conductor is integrated with the other surface of the biasing member.

The biasing member includes electric conductors corresponding to the first electric conductors also in the construction described in Patent Document 2 noted hereinbefore, However, the electric conductors corresponding to the first electric conductors are provided on wall surfaces extending upward from the bottom of the case. This requires the wall surfaces to have a sufficient height for the electric conductors corresponding to the first electric conductors, and this sets a limit to a reduced thickness of the slide switch.

Further, in the construction described in Patent Document 2, the biasing member is formed annular, and the biasing member does not exist under the slide member biased to the neutral position (in the direction of the case). Therefore, the second electric conductor cannot be formed integral with the biasing member. Further, this slide switch has a two-story structure in which the second electric conductor and second electrode pair are located under the first electric conductors and first electrode pairs, which hinders a thinned formation. In addition, because of the two-story structure, an intermediate operation member is required between the electric conductor corresponding to the second electric conductor, and the biasing member.

In the construction of this invention, the first electrode pairs and second electrode pair are arranged in the bottom of the case, and the wall surfaces may be reduced in height easily without being restricted by the electrodes. The slide switch according to this invention does not have a two-story structure having a slidable switch and a depressible switch, but has a single-layer structure that can be formed thin in an advantageous way. This slide switch can be formed of a reduced number of components in that no intermediate operation member is needed.

Thus, according to this characteristic construction, the slide switch has a reduced number of parts, and may be formed thin.

It is preferred that the slide switch according to this invention, in addition to the above construction, is constituted as follows.

The first electrode pair and the projection are arranged at each of four edges of the bottom of the case formed rectangular. When the slide member is operated in the direction of one or two of the projections against the biasing force, the electrodes of the first electrode pair become conductive through the first electric conductor or conductors of the one or two of the projections.

The first electrode pair are arranged at each of four edges of the bottom of the case formed rectangular and the projection at each of four edges of the biasing member also formed rectangular. Then, the back walls of the projections face the center of the rectangular biasing member, and are opposed to one another. The slide member formed rectangular in a similar shape to the case and biasing member are reliably supported at the four edges thereof by the four back wall portions. As a result, the slide member is reliably biased to the neutral position. Since the slide member has its neutral position centrally of the rectangular biasing member, the slide member may be positioned with improved accuracy with respect to the second electrode pair and second electric conductor located under this neutral position.

Preferably, in the slide switch according to this invention, the second electrode pair is in form of concentric circles, and the second electric conductor is in form of a metallic dome.

Where the projection is disposed at each of the four edges of the rectangular biasing member as noted above, the back walls of the projections face the center of the rectangular biasing member, and are opposed to one another. The slide member has its neutral position centrally of the rectangular biasing member. The second electrode pair is in form of concentric circles around the central part of the rectangular biasing member. Thus, the second electrode pair is in an equal positional relationship with all the first electrode pairs at the four sides. As a result, the slide switch provided can reliably perform the two functions as a slidable switch and a depressible switch.

Where the second electric conductor is in the form of a metallic dome for making conductive the second electrode pair in the form of concentric circles, the outer second electrode formed of one of the concentric circles is constant contact with the second electric conductor. A depressing operation can bring the inner second electrode into contact with the second electric conductor. As a result, the second electrode pair may be made conductive reliably even when a deviation occurs with the direction of depression. The central part of the metallic dome is dented by the depressing operation, and is allowed to return upon release of the depressing force. This can give the operator a feeling of clicking accompanying the depressing operation.

It is also preferable that the slide switch according to this invention has a plurality of projection arranged circumferentially of the second electrode pair for regulating the metallic dome.

Where the second electric conductor is formed of a metallic dome which is a separate part, the metallic dome may be displaced from a predetermined position. However, the projections arranged circumferentially of the second electrode pair for regulating the metallic dome as noted above will be effective to suppress such displacement.

Other features and advantages of this invention will become apparent from the following description of embodiments to be taken with reference to the drawings.

DESCRIPTION OF THE PREFERRED EMBODIMENT

An embodiment of this invention will be described hereinafter with reference to the drawings.

Figure 1:
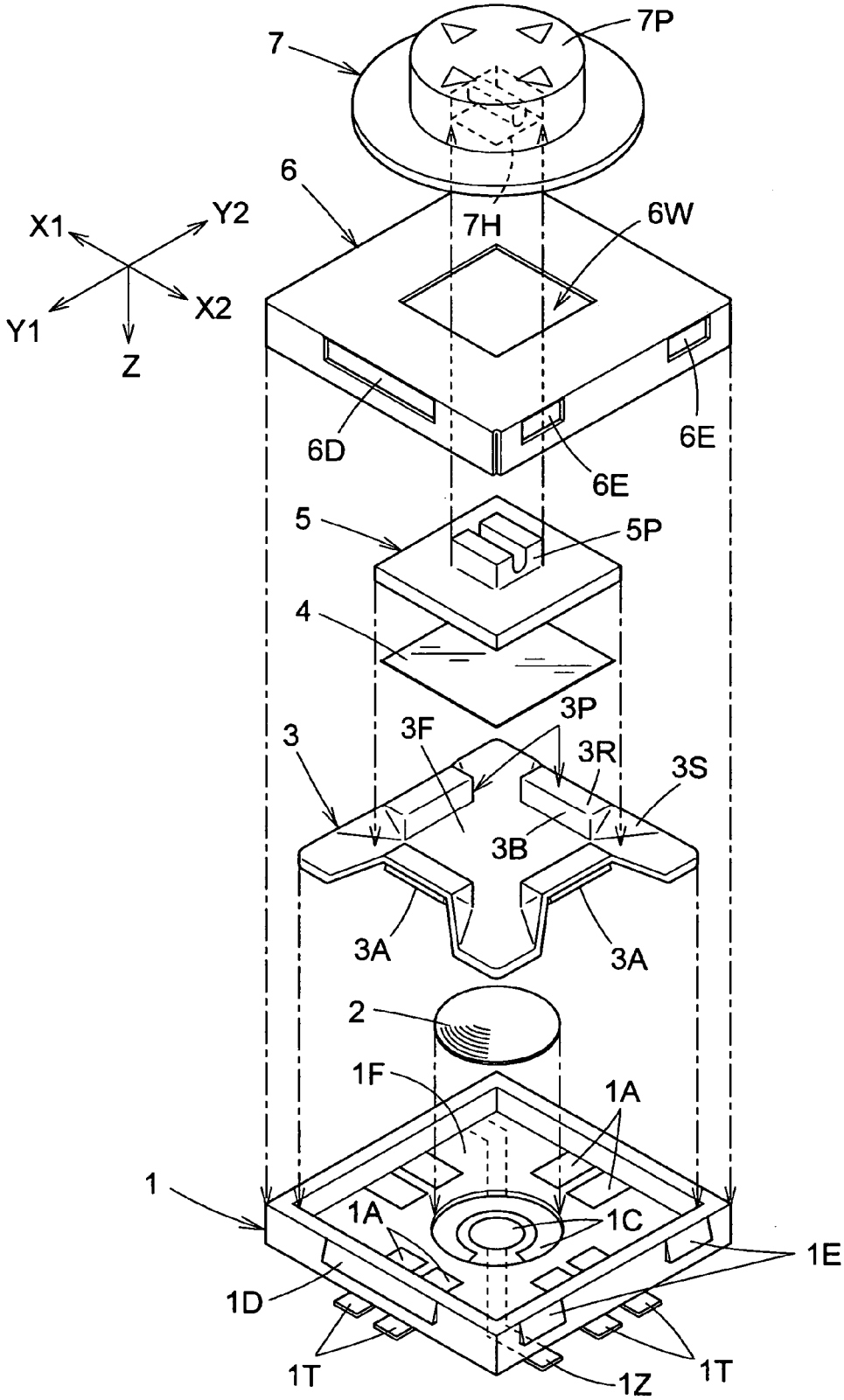
FIG. 1 is an exploded perspective view of a slide switch according to this invention.

As shown in FIG. 1, a slide switch includes a case 1, a metallic dome 2, a biasing member 3, a sheet 4, a slider 5, a cover 6 and a keytop 7 successively stacked on upon another.

The case 1 is formed of LCP resin (liquid crystal polyester resin), for example. LCP resin is a resin material excellent in heat resistance and formability. While lead-free solder has been introduced at a rapid rate in view of the environmental question in recent years, lead-free solder generally has a higher melting point than solder containing lead. It is therefore necessary to raise reflow temperature in time of soldering electronic parts to a substrate by about 10 to 25 deg C. As a result, an improvement in heat resistance is desired for surface mount elements having metal terminals on a mold article such as a connector or a switch. It is therefore desirable to form the case 1 disposed nearest to the substrate by using a resin material excellent in heat resistance as in this embodiment.

In this embodiment, the case 1 is box-shaped with a rectangular (square in this example) bottom 1F and four side walls erected at right angles to the bottom 1F so as to surround peripheral parts of the bottom 1F. A first electrode pair 1A (corresponding to the electrode pair and the first electrode pair of this invention) is arranged at the middle of each side of the bottom 1F, and juxtaposed along each side.

In a central part of the bottom 1F, a second electrode pair 1C is arranged in the form of concentric circles centering on the center of the bottom 1F.

A first terminal pair 1T corresponding to the first electrode pair 1A projects from a lower position outside the middle of each side wall of the case 1. In this embodiment, as shown in FIG. 1, four first terminal pairs 1T are provided to correspond to the first electrode pairs 1A at the four sides.

A second terminal pair 1Z corresponding to the respective electrodes of the second electrode pair 1C project in point symmetry from lower positions in outside end regions of one set of opposite side walls of the case 1. These electrodes and terminals are formed of a conductive material such as phosphor bronze.

As shown in FIG. 1, the second electrode pair 1C is formed by slightly circularly recessing the bottom 1F of the case 1. The metallic dome 2 centrally bulging upward is installed in this circular recess, which is formed of a metal material such as phosphor bronze or stainless steel. This metallic dome 2 corresponds to the second electric conductor of this invention.

The metallic dome 2 constitutes a normally closed contact with the outer electrode of the concentric circular second electrode pair 1C. As described in detail hereinafter, the central part of the metallic dome 2 constitutes a normally open contact with the inner electrode of the second electrode pair 1C. When the central part of the metallic dome 2 is pressed into contact the inner electrode of the second electrode pair 1C, the two electrodes of the second electrode pair 1C are made conductive by the metallic dome 2. A deformation and restoration of the metallic dome 2 can give a feeling of clicking to the user in time of depressing action.

The metallic dome 2 can also share a function with a floor portion 3F of the biasing member 3, which will be described hereinafter, to bias the biases slider 5 to a neutral position in the direction of a depressing operation. Where the biasing member 3 does not have the floor portion 3F, the metallic dome 2 alone may act as a biasing device operable in the direction of the depressing operation.

The biasing member 3 is formed of a material having an electrical insulation property and elastically deformable, such as silicone rubber, EPDM (ethylene-propylene rubber: Ethylene Propylene Diene Monomer), or polyester elastomer (Polyethylene elastomer). As shown in FIG. 1, the biasing member 3, in plan view, has a rectangular (square in this example) outer configuration comparable to the bottom 1F of the case 1, to fit inside the four side walls of the case 1 well.

The biasing member 3 includes projections 3P disposed at middle positions of the four sides thereof and having openings at outer edges of the floor portion 3F. Each projection 3P has a back wall portion 3B rising substantially vertically from the flat floor portion 3F, side wall portions 3S at opposite ends of the back wall portion 3B, and a top portion 3R supported by these wall portions (back wall portion 3B and side wall portions 3S) to be substantially parallel to the bottom 1F. The opening of each projection 3P is surrounded by these wall portions and top unit 3R to open at the outer edge of the floor portion 3F.

The side wall portions 3S slightly diverge from the top portion 3R toward the floor portion 3F. The top portion 3R has a length along the side greater than an interval between the two electrodes of the first electrode pair 1A of the case 1. A first electric conductor 3A also longer than the interval between the two electrodes of the first electrode pair 1A is provided on the back side of the top portion 3R, i.e. inwardly of the opening. The first electric conductor 3A is formed integrally with the biasing member 3 by using a conductive material having a resin impregnated with carbon, for example.

As described in detail hereinafter, the first electric conductor 3A constitutes a normally open contact with the two electrodes of the first electrode pair 1A. When the projection 3P undergoes an elastic deformation into contact with the two electrodes of the first electrode pair 1A, the two electrodes of the first electrode pair 1A become conductive.

The construction for the metallic dome 2 to render the second electrode pair 1C conductive has been described hereinbefore. Where the highly rigid metallic dome 2 is not required to give the feeling of clicking, the following construction may be employed. The electric conductors may be formed integrally with a back surface of the central part of the biasing member 3, i.e. the surface reverse from where the projections 3P are formed. In this case, the biasing member 3 acts as a sole biasing device in the depressing direction of the slider 5.

The slider 5 corresponds to the slide member of this invention. The slider 5 has a body portion of rectangular shape substantially corresponding to a rectangle (square in this example) surrounded by the back wall portions 3B of the projections 3P of the biasing member 3. The floor portion 3F of the biasing member 3 is covered with the sheet 4 approximately the same size as the slider 5, and the slider 5 is placed on the sheet 4 as surrounded by the back wall portions 3B. The slider 5 is biased at the four sides of the body portion by the back wall portions 3B to a neutral position provided by the central parts of the case 1 and biasing member 3.

As described in detail hereinafter, the slide switch is operable by sliding the slider 5 from the neutral position. The biasing member 3 is formed of an elastic material such as rubber as noted hereinbefore, and generally has a high friction coefficient. The sheet 4 is provided to realize excellent slidability of the slider 5 on the floor portion 3F of the biasing member 3 of high friction coefficient.

For this purpose, the sheet 4 may advantageously be formed of PET (Polyethylene Terephthalate) or polyimide which has a low friction coefficient. The slider 5 may be formed of polyamide or the like which has excellent friction wear characteristics, and is slidable stably with little possibility of making noise. The slider 5 has a raised face (FIG. 3), smaller than the body portion, formed on an undersurface (invisible in FIG. 1) of the body portion. The slider 5 is slidable between the raised face and the sheet 4.

The case 1, metallic dome 2, biasing member 3, sheet 4 and slider 5 are stacked successively, and further the cover 6 is stacked thereon. The cover 6 is in the form of a lid having a rectangular (square in this example) outer configuration substantially corresponding to the outer configuration of the case 1, with wall portions depending vertically from respective sides of a flat top portion. The cover 6 is formed thin by using a rigid metal material such as phosphor bronze, stainless steel or the like. The cover 6 has functions to prevent external noise acting on the slide switch, and to maintain the strength of the switch.

The cover 6 has a rectangular (square in this example) window 6W formed in the top portion to be smaller than the outer configuration of the slider 5. The slider 5 includes engaging projection 5P formed on the central part thereof and having a cutout in between. The window 6W has a size for allowing the engaging projections 5P to extend therethrough, and to be movable in response to a sliding operation.

The cover 6 has one engaging hole 6D formed in each wall portion of one opposed pair of wall portions. Further, the cover 6 two engaging holes 6E formed in each wall portion of the other opposed pair of wall portions and shaped differently to the engaging hole 6D. The case 1 has engaging projections 1D, corresponding to the engaging holes 6D, formed on outer surfaces of one opposed pair of side wall portions. Further, the case 1 has engaging projections 1E, corresponding to the engaging holes 6E, formed on outer surfaces of the other opposed pair of side wall portions. When the case 1, metallic dome 2, biasing member 3, sheet 4 and slider 5 are stacked successively, and also the cover 6 is stacked and pressed, the engaging projections 1D and engaging holes 6D are engaged, and the engaging projections 1E and engaging holes 6E are engaged. In this way, the case 1 and cover 6 are fixed together. The metallic dome 2, biasing member 3, sheet 4 and slider 5 are held in a predetermined position (neutral position) between the case 1 and cover 6.

The keytop 7 has a flat portion, a projection 7P formed on the flat portion, and engaging holes 7H formed in the bottom of the flat portion. When the case 1, metallic dome 2, biasing member 3, sheet 4, slider 5 and cover 6 are stacked, the engaging projections 5P of the slider 5 extend out through the window 6W of the cover 6. When the engaging holes 7H of the keytop 7 are engaged with the engaging projections 5P of the slider 5 to fix the slider 5 and keytop 7 together fixed, the slider 5 becomes operable by operation of the keytop 7.

As described in detail hereinafter, when the keytop 7 is slid in a direction indicated by arrow X1, X2, Y1 or Y2 shown in FIG. 1, the slide switch is operated through the slider 5 and biasing member 3. When keytop 7 is depressed in a direction of arrow Z, the slide switch is operated through the slider 5, biasing member 3 and metallic dome 2. A predetermined gap is formed between the keytop 7 and cover 6 for allowing the above operations to be effected smoothly. The keytop 7 is formed of a resin material, and is operated directly by the user.

Figure 2:
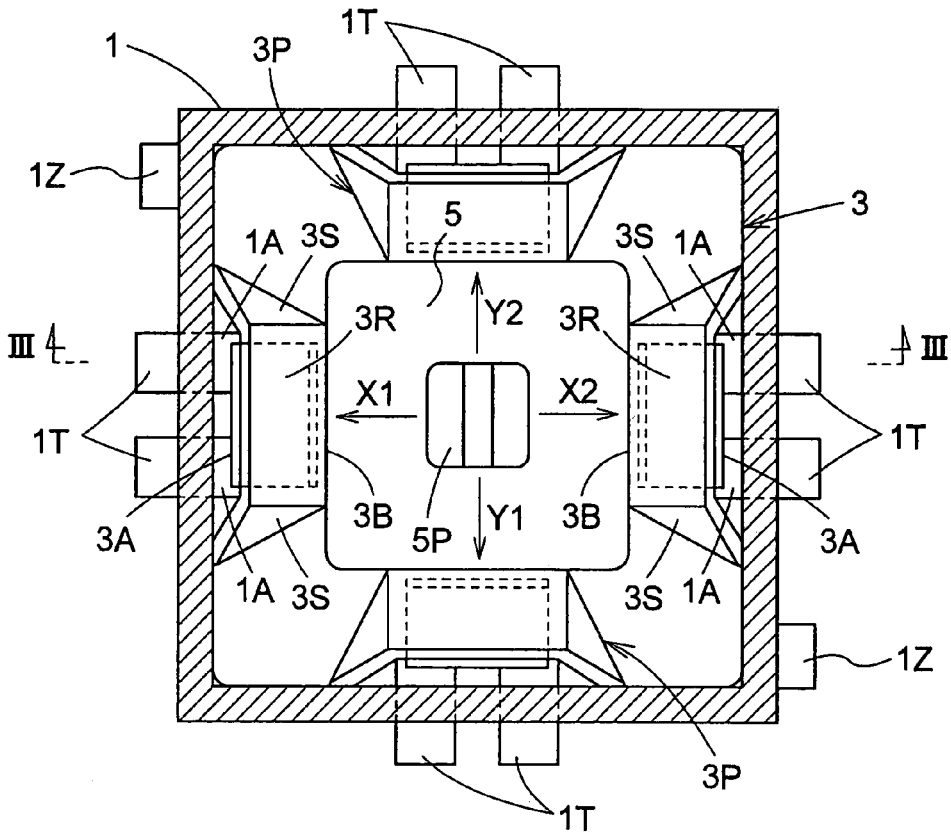
FIG. 2 is a plan view in cross section of the slide switch shown in FIG. 1.
Figure 3:
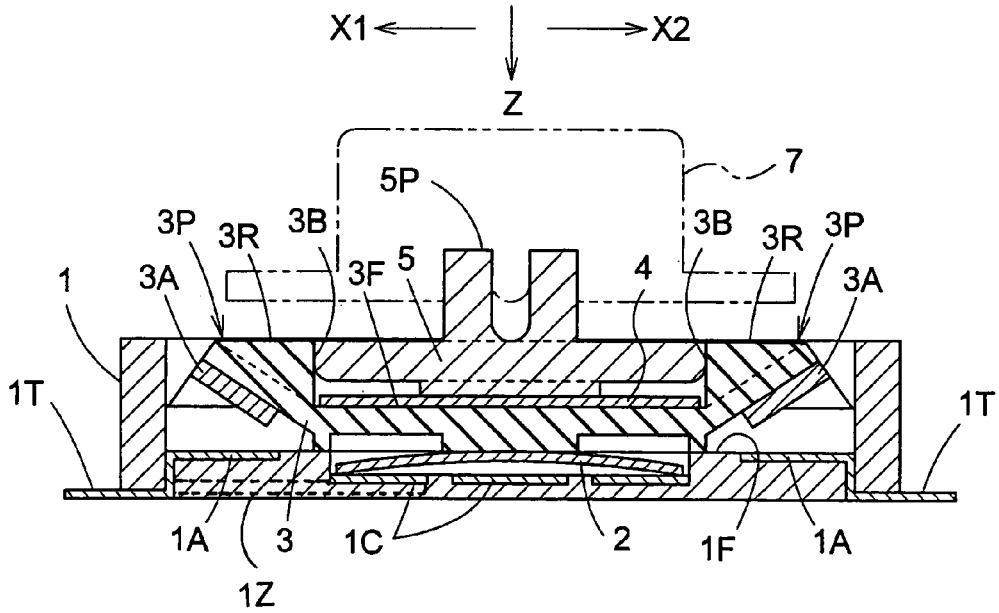
FIG. 3 is a view in vertical section taken on line III-III of FIG. 2.

FIG. 2 is a plan view in cross section of the slide switch shown in FIG. 1. FIG. 3 is a view in vertical section taken on line III-III of FIG. 2. Both figures show the slide switch in the neutral position, i.e. inoperative state. To facilitate understanding, the engaging projections 1D and 1E of the case 1 and the cover 6 are omitted from these figures.

As shown in FIGS. 2 and 3, the biasing member 3 is contained so as to contact the wall portions of the case 1. The slider 5 is supported from the four directions by the back wall portions 3B of the projections 3P of the biasing member 3, and is biased to the neutral position. In this neutral position, the first electric conductors 3A arranged in positions the top portions 3R inside the openings are separated from the first electrode pairs 1A.

The metallic dome 2 is disposed on the second electrode pair 1C provided in the recess of the bottom 1F of the case 1, and supports the center of the floor portion 3F of the biasing member 3 with a biasing force acting upward. The outer electrode of the concentric second electrode pair 1C is contact with the metallic dome 2 acting as the second electric conductor, the inner electrode is separated from the metallic dome 2. Thus, in the state shown in FIGS. 2 and 3, all the contacts of the slide switch are inoperative.

Figure 4:
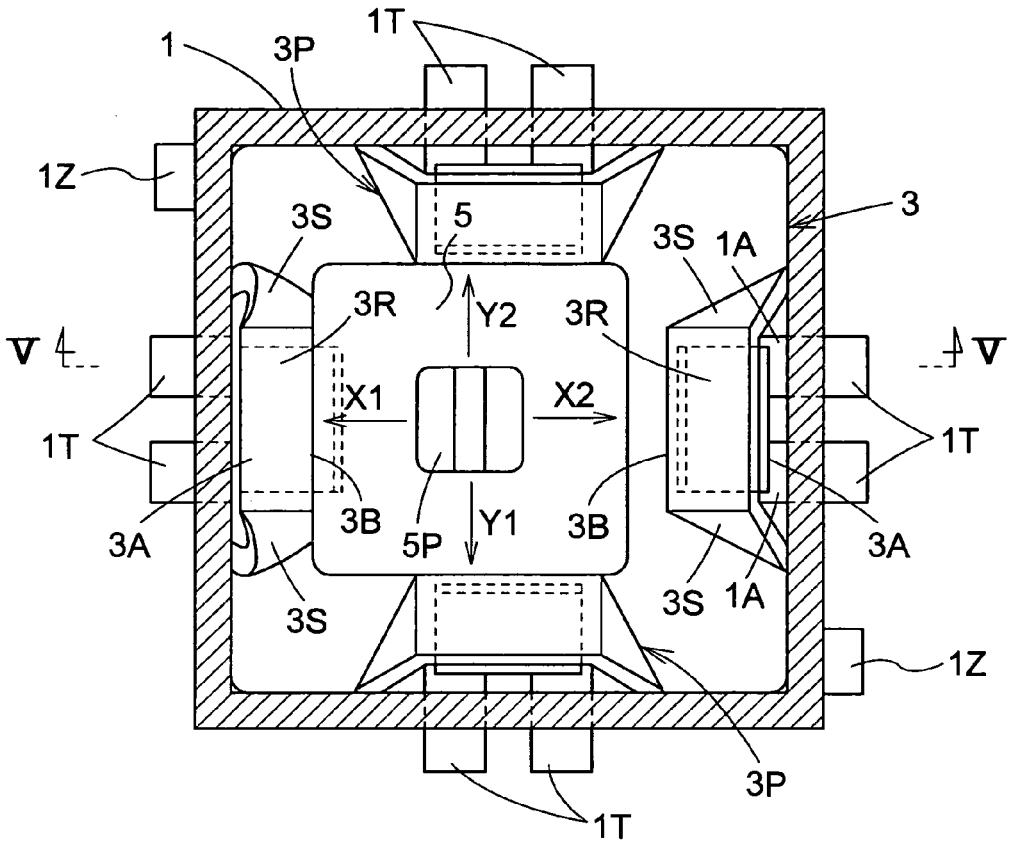
FIG. 4 is a plan view in cross section of the slide switch shown in FIG. 1, with a slide member in a slid state.
Figure 5:
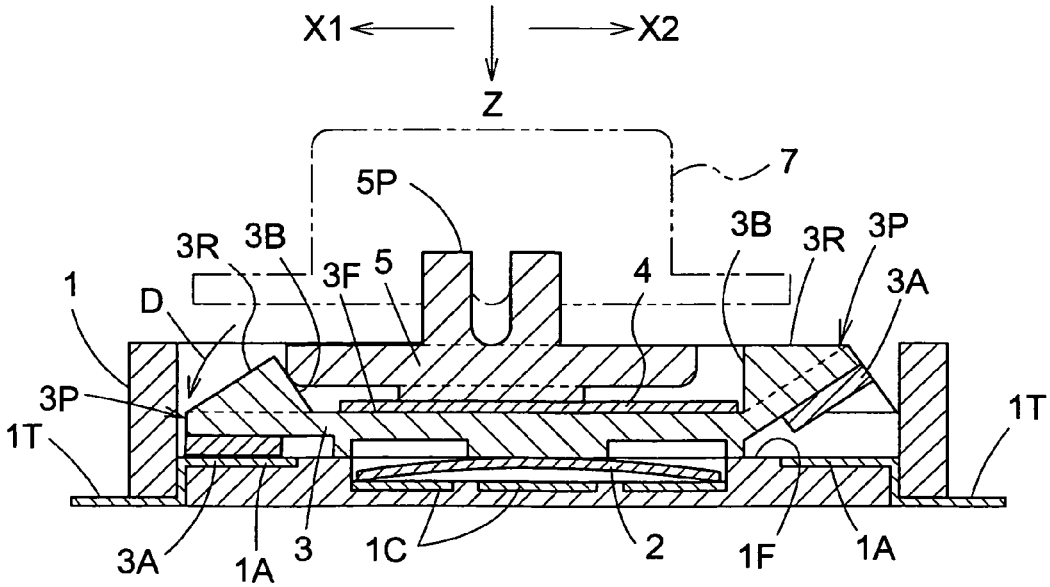
FIG. 5 is a view in vertical section taken on line V-V of FIG. 4.

FIG. 4 is a plan view in cross section of the slide switch shown in FIG. 1, with the slider 5 (keytop 7) slid in the direction of arrow X1 direction against the biasing force of biasing member 3. FIG. 5 is a view in vertical section thereon (i.e. a section taken on line V-V of FIG. 4).

As noted hereinbefore, the biasing member 3 is formed of a highly elastic material. Thus, when the back wall portion 3B is pushed by the slider 5, the projection 3P is elastically deformed. According to the structure of this example, the side wall portions 3S buckle to spread sideways and, with this buckling, the back wall portion 3B also falls over in the direction of movement of the slider 5. The top portion 3R supported by these wall portions also falls toward the floor portion 3F (in the direction of arrow D in FIG. 5). Since the opening is formed in the direction in which the top portion 3R falls, the floor portion 3F does not exist there, but the first electric conductor 3A provided in the opening of the top portion 3R contacts the first electrode pair 1A on the bottom 1F of the case 1. Since the first electric conductor 3A is longer than the interval between the two electrodes of the first electrode pair 1A as noted hereinbefore, the two electrodes of the first electrode pair 1A become conductive.

When this projection 3P is elastically deformed, a reaction of the elastic deformation is transmitted to the operator, and gives a feeling of clicking. A desired feeling of clicking can be provided by suitably changing the material, thickness and so on of the biasing member 3.

It is also possible to make positively a plurality of first electrode pairs 1A simultaneously conductive as described in Patent Document 2. When, for example, the slider 5 is slid in a direction between the directions of arrow X1 and arrow Y2, i.e. toward a corner of the rectangular floor portion 3F, two projections 3P may be elastically deformed at the same time.

In the case of a switch also operable by rocking as described in Patent Document 1, it is unclear whether an operation is made in a direction perpendicular to one side, or obliquely to the side. Therefore, restraint is made in making a plurality of first electrode pairs 1A simultaneously conductive. However, where it is clear as in this embodiment whether an operation is made in a direction perpendicular to one side or obliquely to the side, positive use may be made of an operation in an oblique direction. When sliding operations in oblique directions (toward the corners) are added, eight states can be detected using the four first electrode pairs 1A.

Figure 10:
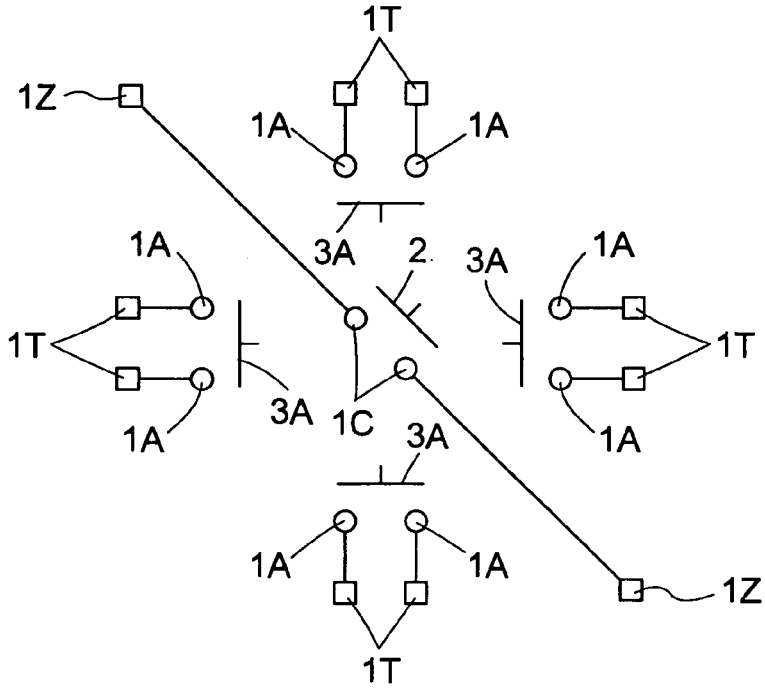
FIG. 10 is a wiring diagram showing an example of terminal connection of a slide switch according to this invention.

FIG. 10 is a wiring diagram showing an example of terminal connection of a slide switch according to this invention. As shown, four conductive states are detectable with the four first electrode pairs 1A and four first electric conductors 3A. In addition, it is possible to detect four conductive states where two adjacent pairs are simultaneously conductive. Thus, eight conductive states in total may be detected.

Figure 6:
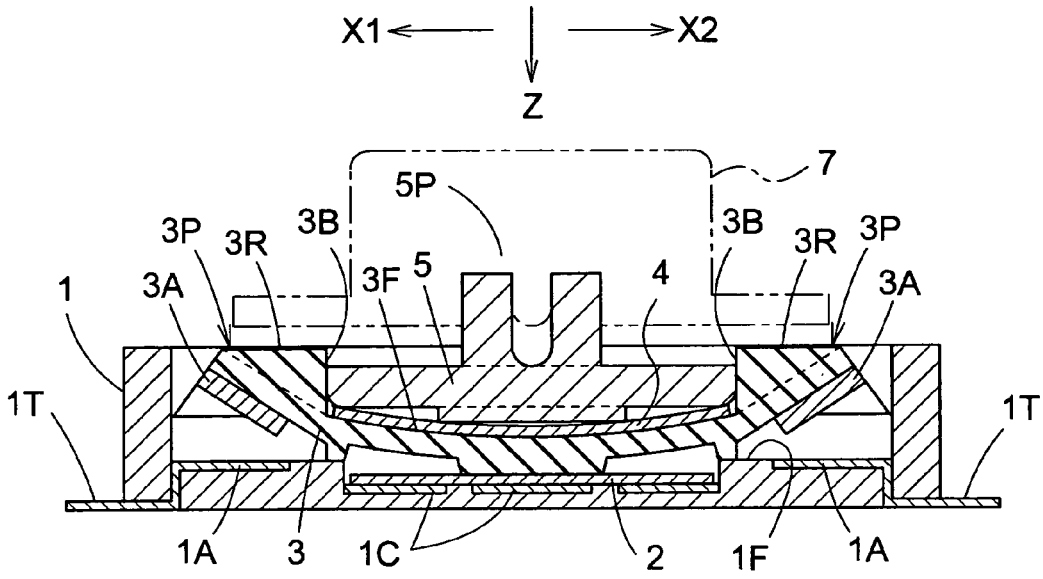
FIG. 6 is a view in vertical section of the slide switch shown in FIG. 1, with the slide member in a depressed state.

FIG. 6 is a view in vertical section of the slide switch shown in FIG. 1, with the slider 5 in a state of being depressed in the direction of arrow Z. As the slider 5 is depressed, the sheet 4, biasing member 3 and metallic dome 2 undergo an elastic deformation. As described hereinbefore, the edge of metallic dome 2 constitutes a normally closed contact with the outer electrode of the concentric second electrode pair 1C. The central part of metallic dome 2 constituting a normally open contact with the inner electrode of the concentric second electrode pair 1C contacts the inner electrode as a result of the elastic deformation. In this way, the two electrodes of the second electrode pair 1C become conductive. Since a sliding force is not applied to any projection 3P of the biasing member 3 at this time, the first electric conductor 3A provided for each projection 3P does not make the first electrode pair 1A conductive. That is, since the sliding operation and depressing operation are clearly distinguishable, the conduction of the first electrode pairs 1A and that of the second electrode pair 1C can be clearly separated.

The construction in this embodiment does not require an intermediate operation member for transmitting a depressing force of the slider 5 as disclosed in Patent Document 2. The first electrode pairs 1A and second electrode pair 1C are arranged substantially coplanar (on the bottom 1F), resulting in a thin construction as compared with the conventional switches. That is, the slide switch according to this invention has a reduced number of parts, and can be formed thin.

This invention has been described using the preferred embodiment for facilitating understanding of the technical concept. The invention is of course not limited to the above embodiment. Modified embodiments will be described briefly hereinafter.

First Modified Embodiment

Figure 7:
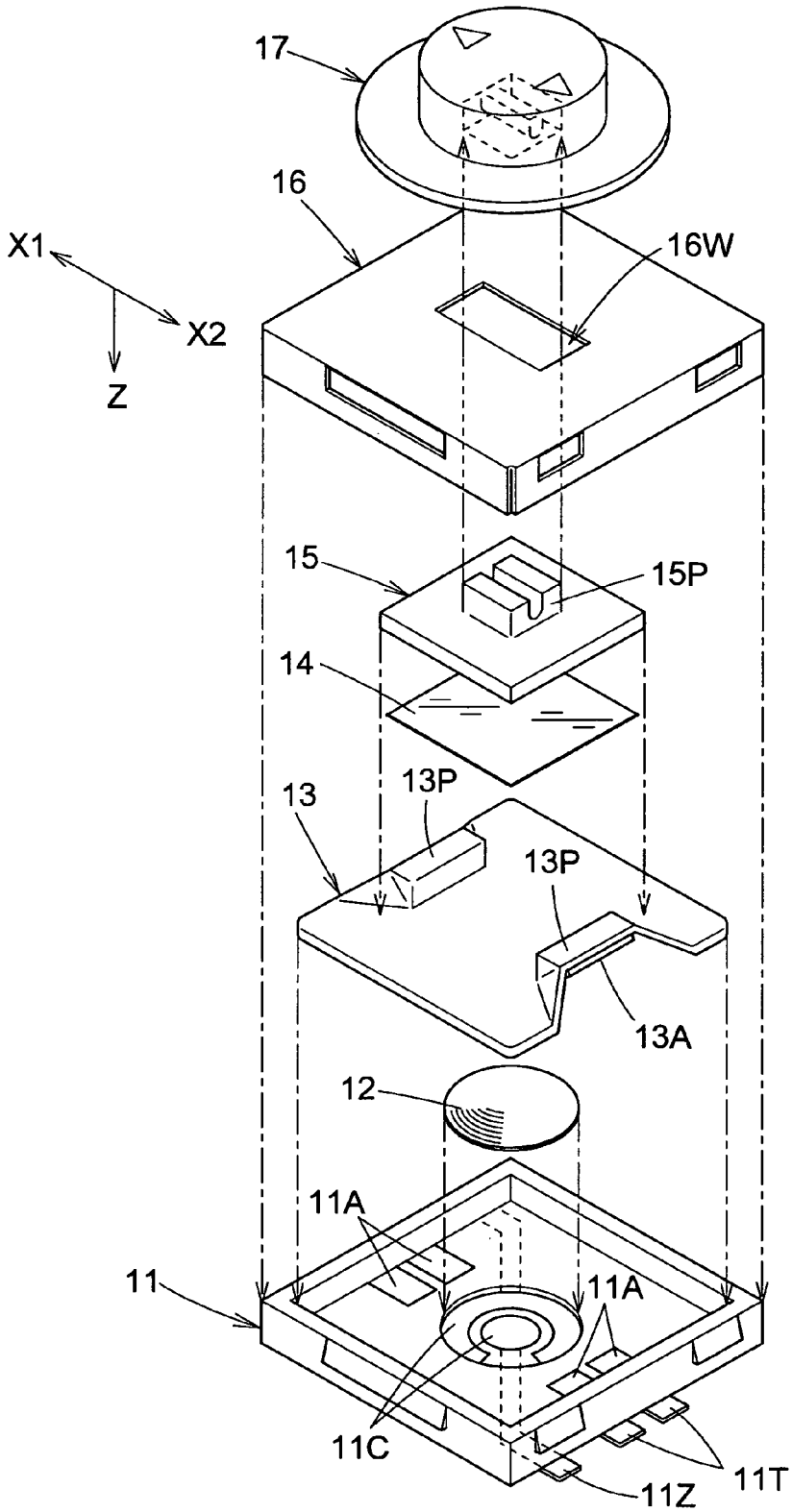
FIG. 7 is an exploded perspective view of a slide switch in a first modified embodiment of this invention.

FIG. 7 is an exploded perspective view of a slide switch in a first modified embodiment of this invention. As shown, a slide switch includes a case 11, a metallic dome 12 acting as a second electric conductor, a biasing member 13, a sheet 14, a slider 15 acting as a slide member, a cover 16 and a keytop 17 successively stacked on upon another.

The biasing member 13 includes two projections 13P, and the slider 15 is biased to a neutral position pinched between the two projections 13P. The slider 15 is slidable in directions of arrow X1 and arrow X2 against the biasing force of the projections 13P. The cover 16 has a rectangular window 16W which does not obstruct movement in the directions of arrows X1 and X2 of engaging projections 15P of the slider 15, but restricts movement in directions perpendicular to the directions of, arrows X1, X2 and Z (e.g. directions of arrows Y1 and Y2 shown in FIG. 1).

The window 16W of the cover 16 may be reduced in size to restrict movement in one of the directions of arrow X1 and X2. That is, one of the short sides of the window 16W substantially contacts the engaging projections 15P in the neutral position. The short side of the window 16W and the projection 13P of the biasing member 13 may bias the slider 15 to the neutral position. Then, the slider 15 is slidable in the direction of arrow X1 or X2, and depressible in the direction of arrow Z. In this case, the slide switch has the following construction.

The case 11 includes one first electrode pair 11A and one second electrode pair 11C arranged on the bottom. The biasing member 13 includes a back wall portion extending upward from a flat floor portion for biasing the slider 15 to the neutral position, and a projection 13P having a first electric conductor 13A at a side opposite the back wall portion. The metallic dome 12 acting as a second electric conductor is disposed adjacent the surface of the biasing member 13 reverse from where the projection 13P is formed. The case 11 and biasing member 13 are installed such that the first electrode pair 11A and first electric conductor 13A are opposed to each other, and that the second electrode pair 11C and metallic dome 12 are opposed to each other.

When the slider 15 is operated in the direction of projection 13P against the biasing force, the projection 13P is elastically deformed to make conductive the first electrode pair 11A opposite the first electric conductor 13A. When the slider 15 in the neutral position is pressed in the direction of the floor portion of the biasing member 13, the floor portion is elastically deformed, whereby the metallic dome 12 acting as the second electric conductor makes the second electrode pair 11C conductive.

Second Modified Embodiment

This invention of course is not limited to slide switches performing two types of operations, i.e. the sliding operation and depression, but is applicable also to slide switches without the depression mode.

Figure 8:
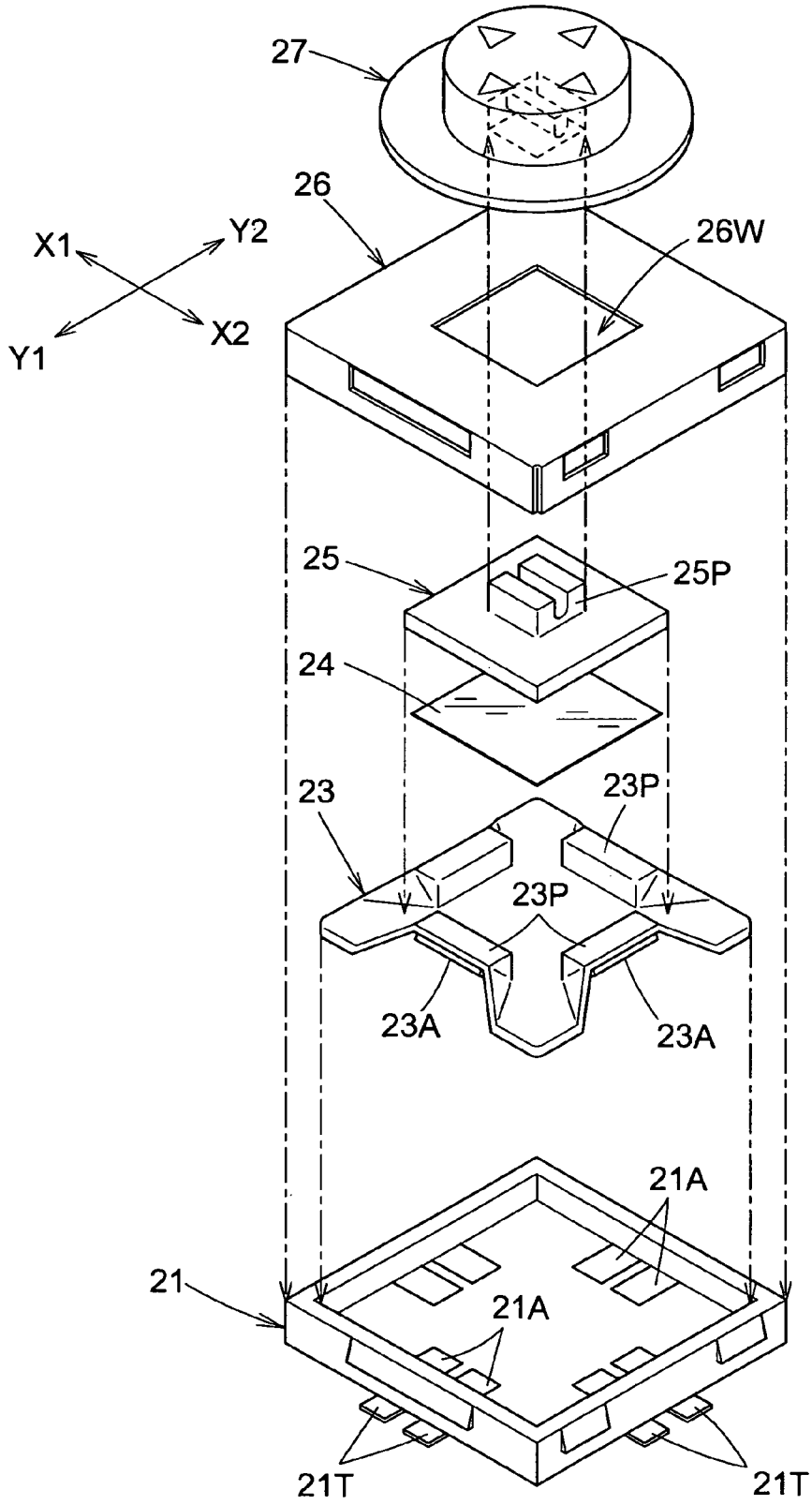
FIG. 8 is an exploded perspective view of a slide switch in a second modified embodiment of this invention.

FIG. 8 is an exploded perspective view of a slide switch in a second modified embodiment of this invention. As shown, the slide switch includes a case 21, a biasing member 23, a sheet 24, a slider 25 acting as a slide member, a cover 26 and a keytop 27 successively stacked on upon another.

The case 21 includes at least one electrode pair 21A arranged on the bottom. The biasing member 23 includes projections 23P each having a back wall portion extending upward from a flat floor portion for biasing the slider 25 to a neutral position, and an electric conductor 23A disposed opposite the back wall portion. In the example shown in FIG. 8, electrode pairs 21A are arranged at four edges of the bottom of the square case 21, and the projections 23P are provided at four edges of the square biasing member 23.

The case 21 and biasing member 23 are installed such that the electrode pairs 21A and electric conductors 23A are opposed to each other. When the slider 25 is operated in the direction or directions of one or two projections 23P against the biasing force of the projections 23P of the biasing member 23, the projection or projections 23P is/are elastically deformed in the same way as shown in FIGS. 2 through 5. Then, the conductor or conductors 23A of the projection or projections 23P make(s) conductive the electrode pair or pairs 21A opposed thereto.

Third Modified Embodiment

Figure 9:
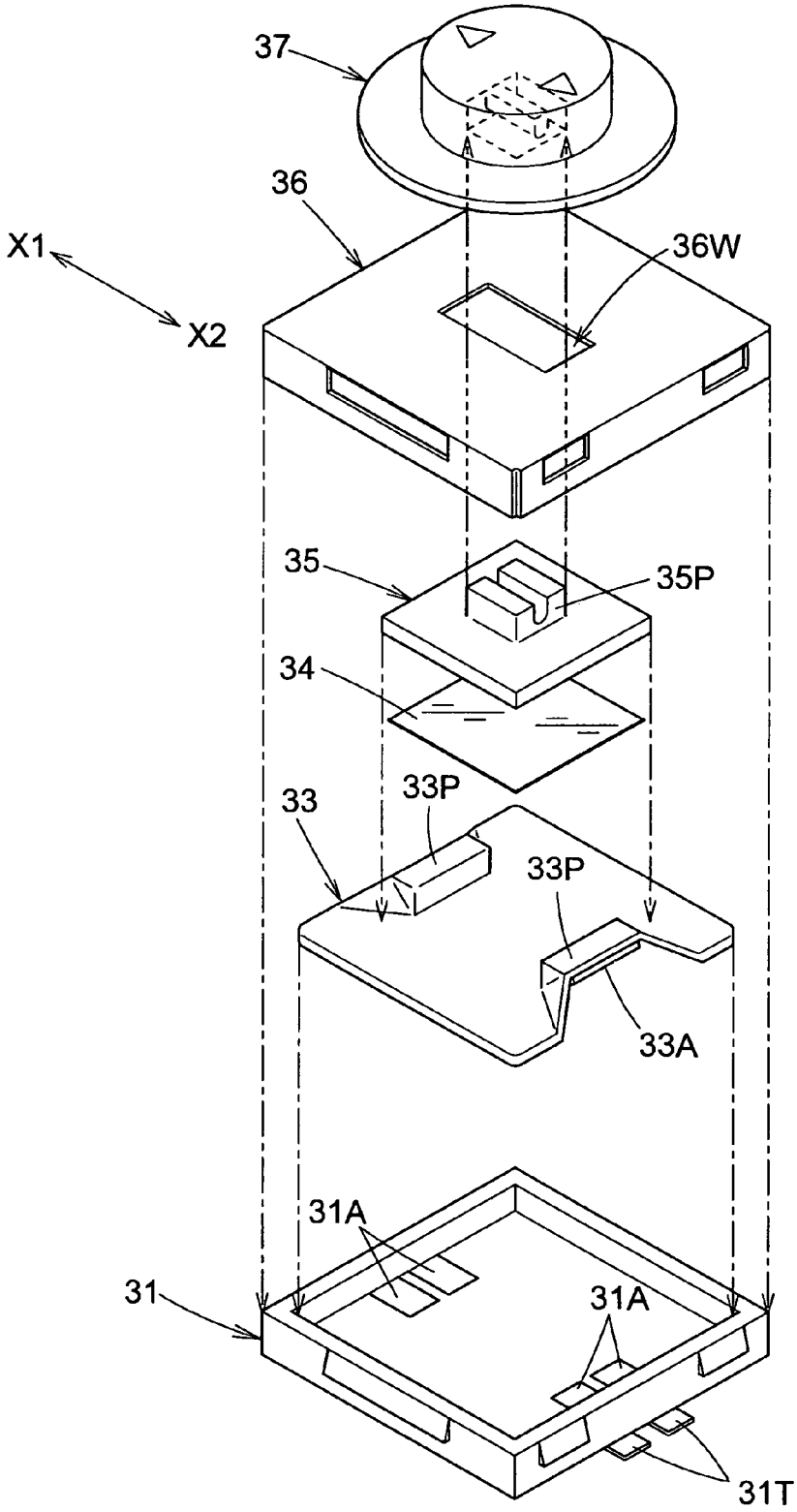
FIG. 9 is an exploded perspective view of a slide switch in a third modified embodiment of this invention.

FIG. 9 is an exploded perspective view of a slide switch in a third modified embodiment of this invention. As shown, the slide switch includes a case 31, a biasing member 33, a sheet 34, a slider 35 acting as a slide member, a cover 36 and a keytop 37 successively stacked on upon another.

In this embodiment, the biasing member 33 includes two projections 33P, and the slider 35 is biased to a neutral position pinched between the two projections 33P. The slider 35 is slidable in directions of arrow X1 and arrow X2 against the biasing force of the projections 33P. The cover 36 has a rectangular window 36W which does not obstruct movement in the directions of arrows X1 and X2 of engaging projections 35P of the slider 35, but restricts movement in directions perpendicular to the directions of arrows X1, X2 and Z (e.g. directions of arrows Y1 and Y2 shown in FIG. 1).

The window 36W of the cover 36 may be reduced in size to restrict movement in one of the directions of arrow X1 and X2. That is, one of the short sides of the window 36W substantially contacts the engaging projections 35P in the neutral position. The short side of the window 36W and the projection 33P of the biasing member 33 may bias the slider 35 to the neutral position. Then, the slider 35 is slidable only in the direction of arrow X1 or X2. In this case, the slide switch has the following construction.

The case 31 includes two electrode pairs 31A arranged on the bottom. The biasing member 33 includes projections 33P each having a back wall portion extending upward from a flat floor portion for biasing the slider 35 to the neutral position, and an electric conductor 33A disposed opposite the back wall portion. The case 31 and biasing member 33 are installed such that the electrode pairs 31A and electric conductors 33A are opposed to each other. When the slider 35 is operated in the direction of projection 33P against the biasing force, the projection 33P is elastically deformed to make conductive the electrode pair 31A opposite the electric conductor 33A.

Fourth Modified Embodiment

This invention is not limited, in respect of terminal connection, to the constructions shown in FIGS. 1 through 10. FIG. 10 shows an example of terminal connection for the slide switch shown in FIG. 1. The illustrated terminal connection can detect independently the conduction of the two electrodes constituting each of the first electrode pairs 1A and second electrode pair 1C. This terminal connection can form five closed circuits independently where, as shown in FIG. 10, the four first electrode pairs 1A and one second electrode pair 1C are provided.

Figure 11:
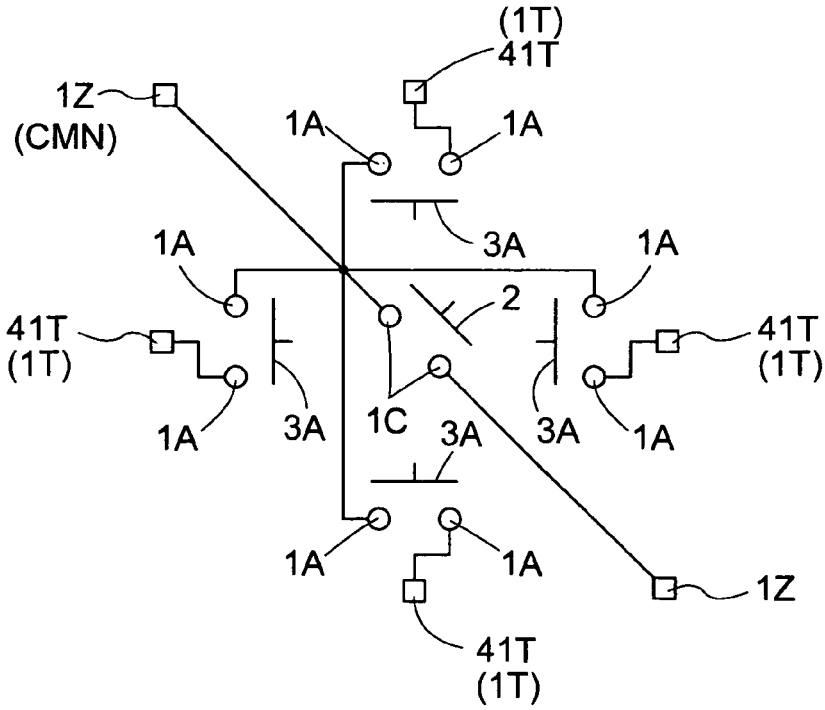
FIG. 11 is a wiring diagram showing an example of terminal connection of a slide switch according to this invention.

FIG. 11 shows an example where the four first electrode pairs 1A and one second electrode pair 1C are provided, and one electrode in each electrode pair serves a terminal common to all (common terminal CMN). In this case, each first terminal pair 1T for connection outside the slide switch becomes one first terminal 41T. In the example shown in FIG. 11, the second terminal pair 1Z has two terminals as in FIG. 10, and one of the terminals serves as a common terminal CMN.

The common terminals CMN provided in this way may be used advantageously as follows, for example. As described with reference to FIGS. 4 and 5, the slider 5 is slidable not only in the direction perpendicular to each side, but also in the direction of each corner. When the slider 5 is slid toward a corner, the two adjacent first electrode pairs 1A become conductive. In order to check whether the two first electrode pairs 1A have become conductive simultaneously, it is necessary to check the conduction of each first electrode pair 1A. However, where the common terminals are provided as shown in FIG. 11, a confirmation may be made of the simultaneous conduction of two first electrode pairs 1A by detecting conduction between one first terminal 41T and a first terminal 41T adjacent thereto. Thus, this slide switch allows adjoining circuits to be compact. Of course, various changes are possible for terminal connection, without being restricted to the arrangements shown in FIGS. 10 and 11.

Fifth Modified Embodiment

Figure 12:
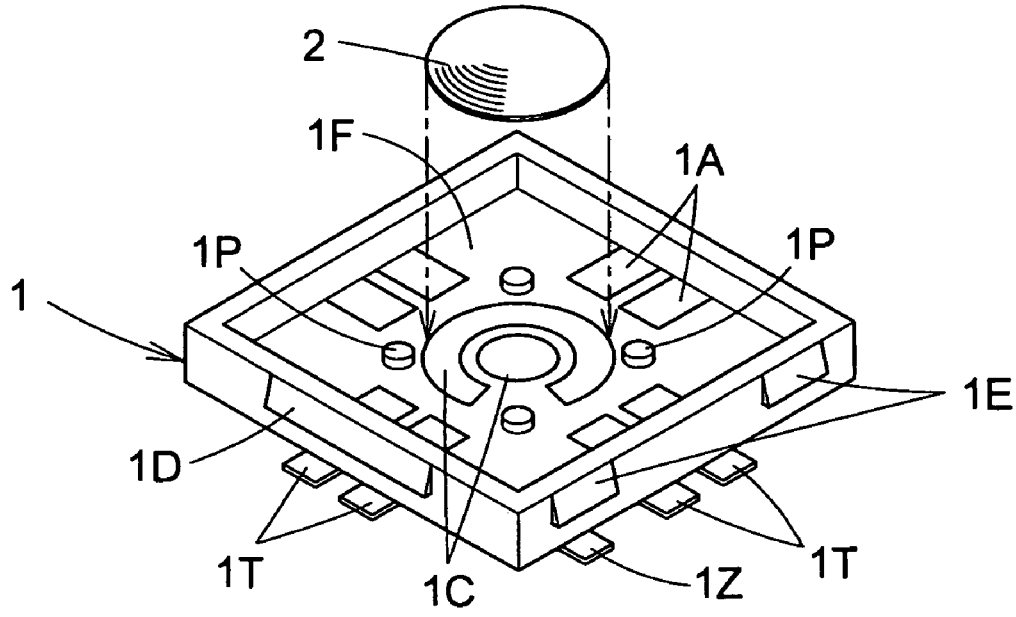
FIG. 12 is an exploded perspective view of a slide switch in a third modified embodiment of this invention.

One of the characteristics of this invention is a slide switch can be formed thin, compared with the conventional switches, which is achieved by arranging the first electrode pairs 1A and second electrode pair 1C substantially coplanar (on the bottom 1F) as shown in FIGS. 1 through 7. As described hereinbefore, in order keep in a predetermined position the metallic dome 2 acting as the second electric conductor corresponding to the second electrode pair 1C, a recess is formed in the central part of the bottom 1F of the case 1, and the second electrode pair 1C is formed in this recess. The metallic dome 2 is retained in this recess. This invention is not limited to the above construction, but may be modified as shown in FIG. 12, for example. The case 1 does not have the recess formed in the central part of the bottom 1F, but the first electrode pair 1A and second electrode pair 1C are arranged on the same plane. Projections 1P may be formed for maintaining the metallic dome 2 in a predetermined position.

As described above, this invention provides slide switches having a reduced number of parts and formed thin.

The invention claimed is:

1. A slide switch comprising:

a slide member slidably mounted in a case; and a biasing member for biasing the slide member to a neutral position;

wherein the slide switch produces an electrically conductive state when said slide member is operated against a biasing force of said biasing member;

wherein said case includes at least one electrode pair arranged in a bottom thereof;

wherein said biasing member includes projections each having a back wall portion for biasing said slide member to said neutral position, and an electric conductor disposed opposite said back wall portion;

wherein, when said slide member is operated in the direction of one of said projections against the biasing force, said one of said projections is elastically deformed whereby electrodes of said at least one electrode pair become conductive through said electric conductor; and wherein said at least one electrode pair and said projections are arranged at each of four edges of said bottom of said case formed rectangular and the projections extend about an outer periphery of the slide member.

2. A slide switch as defined in claim 1, wherein, when said slide member is operated in the direction of two of said projections against said biasing force, electrodes of each of said at least one electrode pair become conductive through each said electric conductor of said two of said projections.

3. A slide switch comprising:

a slide member slidably mounted in a case; and a biasing member for biasing the slide member to a neutral position;

wherein the slide switch produces an electrically conductive state when said slide member is operated against a biasing force of said biasing member;

wherein said case includes at least one first electrode pair and one second electrode pair arranged in a bottom thereof;

wherein said biasing member includes projections each having a back wall portion extending upward from one surface of a flat floor for biasing said slide member to said neutral position, and a first electric conductor disposed opposite said back wall portion, a second electric conductor being disposed adjacent a reverse surface of said floor;

wherein, when said slide member is operated in the direction of one of said projections against the biasing force, said one of said projections is elastically deformed whereby electrodes of said at least one first electrode pair become conductive through said first electric conductor; and wherein, when said slide member in said neutral position is pressed in the direction of said floor, electrodes of said second electrode pair become conductive through said second electric conductor.

4. A slide switch as defined in claim 3, wherein:

said at least one first electrode pair and said projections are arranged at each of four edges of said bottom of said case formed rectangular; and wherein, when said slide member is operated in the direction of two of said projections against said biasing force, electrodes of each of said at least one first electrode pair become conductive through each said first electric conductor of said two of said projections.

5. A slide switch as defined in claim 3, wherein:

said second electrode pair are in form of concentric circles; and said second electric conductor is in form of a metallic dome.

6. A slide switch as defined in claim 5, wherein a plurality of projections are arranged circumferentially of said second electrode pair for regulating said metallic dome.

* * * * *